US005448984A

United States Patent [19]

Brovelli

[11] Patent Number: 5,448,984

[45] Date of Patent: Sep. 12, 1995

[54] TOY THAT SELECTIVELY SHOOTS SOFT BALLS AND WATER

[75] Inventor: Virginio Brovelli, Taino, Italy

[73] Assignee: Lanard Toys Limited, Hong Kong

[21] Appl. No.: 109,363

[22] Filed: Aug. 19, 1993

[51] Int. Cl.[6] ..... F41B 11/26

[52] U.S. Cl. ..... 124/69; 124/73

[58] Field of Search ..... 124/56, 63, 64, 67, 124/69–73; 222/79

[56] References Cited

U.S. PATENT DOCUMENTS

| | | | |
|---|---|---|---|
| 1,233,944 | 7/1917 | Wissler | 124/69 X |
| 2,101,762 | 12/1937 | Straub | 124/71 |
| 2,725,868 | 12/1955 | Foster | 124/64 X |
| 2,762,357 | 9/1956 | Foster | 124/70 X |
| 3,055,352 | 9/1962 | Foster | 124/64 |
| 3,236,521 | 2/1966 | Knott | 124/64 X |
| 3,308,803 | 3/1967 | Walther | 124/69 |
| 3,765,396 | 10/1973 | Kienholz et al. | 124/72 X |
| 4,038,961 | 8/1977 | Olofsson | 124/69 |
| 5,184,755 | 2/1993 | Brovelli | 222/79 |
| 5,241,944 | 9/1993 | Rappaport | 124/67 |
| 5,305,919 | 4/1994 | Johnson et al. | 222/79 |
| 5,310,089 | 5/1994 | Hudgins | 222/79 |

*Primary Examiner*—Randolph A. Reese

*Assistant Examiner*—John A. Ricci

*Attorney, Agent, or Firm*—Brumbaugh, Graves, Donohue & Raymond

[57] ABSTRACT

A toy that selectively shoots (1) a compressible ball, (2) a compressible ball and a water spray, (3) a water spray and (4) a water stream comprises a tank adapted to contain air and water under pressure, a pump for pumping air into the tank, a discharge valve having an inlet and an outlet, a water supply conduit leading from the tank to the discharge valve inlet and an air supply conduit leading from the tank to the discharge valve inlet. A cap or other device is provided for selectively opening and closing the air supply conduit so as to permit or prevent, respectively, air from flowing from the tank to the discharge valve. A ball magazine defines an air pressure chamber that receives a compressible ball and has an opening that is smaller than the ball so that the ball is discharged through the opening only when a predetermined force due to air pressure in the chamber is applied to it, whereupon the ball is deformed and is discharged from the magazine. A discharge conduit leads from the discharge valve outlet to the ball magazine chamber and has a nozzle opening into the chamber.

25 Claims, 4 Drawing Sheets

TOY THAT SELECTIVELY SHOOTS SOFT BALLS AND WATER

BACKGROUND OF THE INVENTION

Squirt guns and other toys that shoot things have long been popular. Among the items that fall into the general category of shooting toys are air pressure-type water guns and guns that shoot soft balls using air pressure. Heretofore, air pressure-type water guns and air pressure-operated toys that shoot missiles of some sort have been entirely separate items, so a child who desired to have both toys had to buy one of each.

SUMMARY OF THE INVENTION

The present invention is a toy that selectively shoots a water stream and a compressible ball. Optionally, the toy can be arranged, in addition to shooting either water alone or a ball alone, to shoot simultaneously a compressible ball and a water spray or a water spray alone, thus having four modes of operation. The user can, by making simple changes in the configuration of a single toy, select one of the operating modes. The invention has the advantage of providing its owner with a variety of play modes without the cost and inconvenience of having several different toys. A variety of play modes is known in the industry to enhance greatly the play value of a toy.

A toy, according to the present invention, comprises a tank adapted to contain air and water under pressure, a pump for pumping air into the tank, a discharge valve having an inlet and an outlet, and a fluid supply conduit leading from the tank to the discharge valve inlet. A ball magazine defining an air pressure chamber selectively, at the option of the user, receives at least one compressible ball and has an opening that is smaller than the ball so that the ball is discharged through the opening only when a predetermined force due to air pressure in the chamber is applied to it, whereupon the ball is deformed and is discharged from the magazine. A discharge conduit leads from the discharge valve outlet to the ball magazine chamber and has a nozzle opening into the chamber.

In some embodiments, the magazine is adapted to receive a multiplicity of balls and has a device or mechanism for pushing the ball or balls in the magazine chamber toward the magazine opening so that a ball next to be shot seats in the opening and pressure can build up in the magazine chamber. In one form, the pushing device includes a pusher member movable by fluid under pressure delivered from the tank when the discharge valve is opened. The pusher member may, for example, be a piston received in a cylinder that receives fluid from the tank through the discharge conduit when the discharge valve is opened. In an advantageous arrangement, the pusher member has a passage having one end communicating with the discharge conduit. The nozzle is attached to the other end of the pusher member, proximate to the magazine and communicates with the passage.

Preferably, a magazine that can receive more than one ball is configured to enable fluid to bypass balls received in it remote from the ball seated in the opening so that pressure is applied directly to the ball seated in the opening. For example, the magazine may have lengthwise extending grooves that allow fluid to flow past the balls remote from the opening. In a preferred embodiment of the invention, the end of the piston proximate to the magazine is annular, projects beyond the nozzle, and has openings to enable fluid to flow into the magazine chamber past a ball engaged by the annular end of the pusher.

As an optional, though preferred feature, the toy further includes an air supply conduit leading from the tank to the discharge valve inlet, and a device for selectively opening and closing the air supply conduit to enable or prevent, respectively, air from flowing from the tank to the discharge valve inlet through the air supply conduit. With an air supply conduit, in addition to the fluid supply conduit, the toy is adapted to shot simultaneously a ball and a water spray when the air supply conduit is open, the tank contains both water and air, and a ball is in the magazine and to shoot a water spray alone when the tank contains both water and air and no ball is present in the magazine. Advantageously, the air supply conduit is a substantially rigid tube and has an air inlet opening for receiving air in the tank that is located a substantial distance above the bottom of the tank when the toy is in use so that the opening is above the level of a quantity of water received in the bottom of the tank. When there is no water in the tank, only air is delivered, thus providing the ball-shooting only mode. When there is water in the tank and the water surface is below the level of the inlet opening of the air supply conduit, both water and air will be delivered from the tank when the discharge valve is opening. If the magazine is installed and a ball is in the magazine, the air supplied to the magazine will shoot the ball, and a spray of water will be discharged after the ball has been shot—this is the mode in which the ball and a water spray are both shot by the toy. If the ball is not used, in this mode, the toy shoots a water spray. By closing the inlet to the air supply conduit and not using the ball, the toy shots a stream of water from the nozzle. In all modes, it is, of course, necessary to use the pump to pressurize the air in the tank.

A toy according to the invention may be configured to resemble a gun by providing a case having a barrel and a handle, the nozzle, preferably, being located at the end of the barrel. It is desirable to have the tank removably attached to the case. Similarly, either the entire magazine is removably attached to the end of the barrel or the part of the magazine having the opening through which the ball is ejected is detachable from the rest of the magazine so that the ball or balls can be loaded into the magazine. In a preferred arrangement, according to the invention, the magazine and the end of the barrel are tubular, the magazine is telescopically received over the end portion of the barrel, and a seal is provided between the end portion of the barrel and the magazine. A suitable means of attachment between the magazine and the barrel is a bayonet coupling.

For a better understanding of the invention, and a description of additional preferred features, reference may be made to the following description of an exemplary embodiment, taken in conjunction with the accompanying drawings.

DESCRIPTION OF THE EMBODIMENT

Figure 1A:
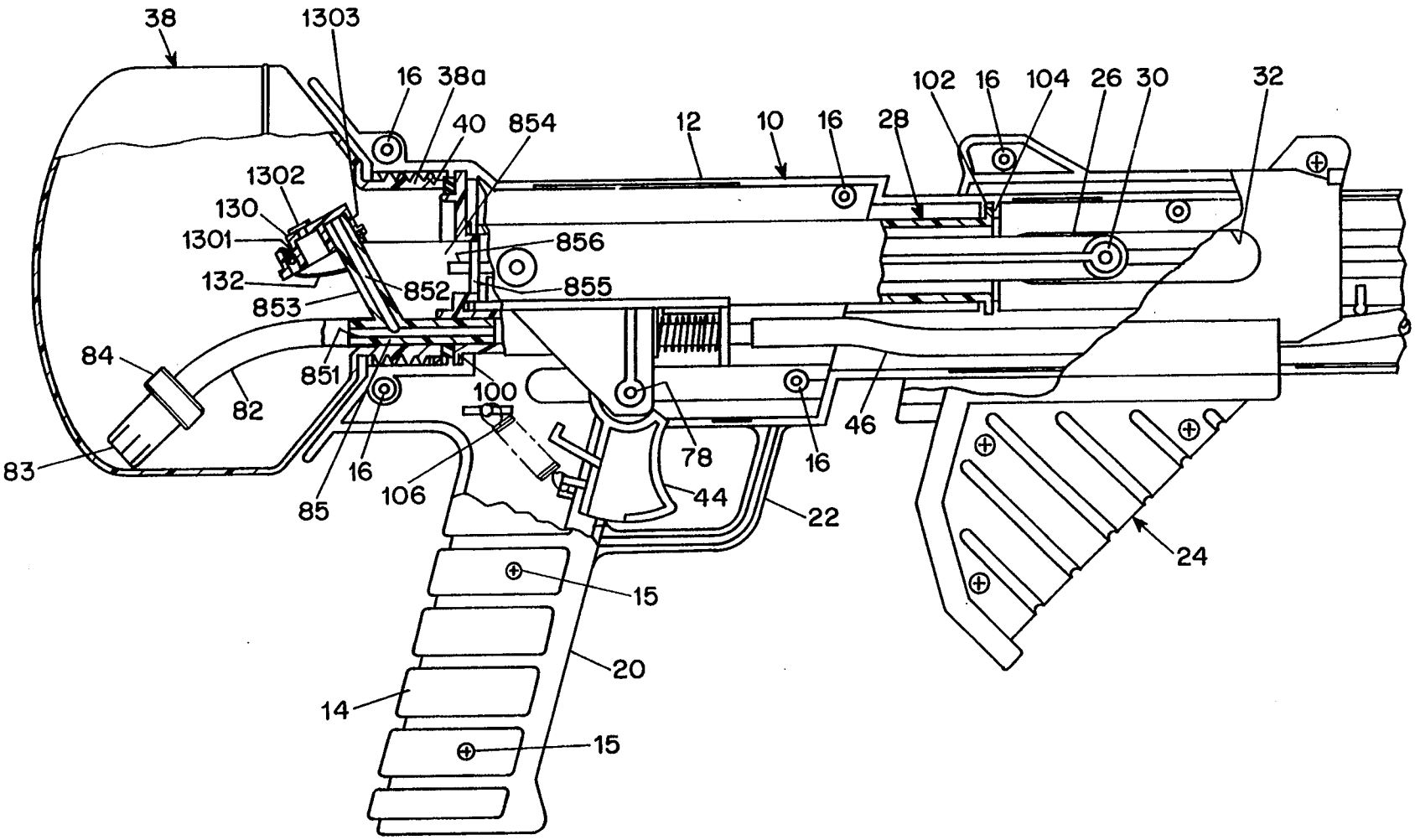
FIGS. 1A and 1B together make up a side elevational view of the embodiment, parts of the case and other components being broken away and shown in cross-section.

The embodiment shown in the drawings is a modification of a prior art air pressure water gun, which has been marketed throughout the world by the assignee of the present invention under the trademark "KAHUNA." The "KAHUNA" water gun is described and shown in U.S. Pat. No. 5,184,755 (Brovelli, issued Feb. 9, 1993), which is incorporated into the present specification by reference.

Figure 1B:
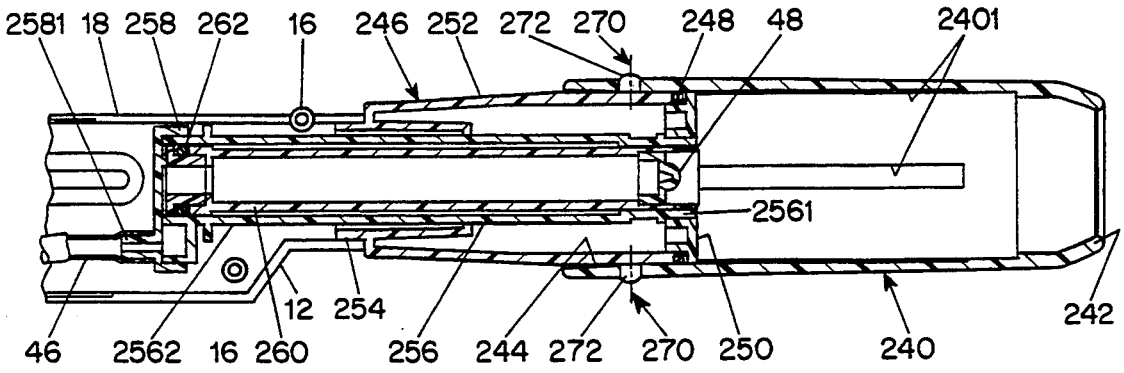

Like many toys (and other articles for that matter), the embodiment has a hollow case 10 that is composed of two halves 12 and 14 that are placed edge to edge and joined by screws 15 that pass through holes in one case section 14 and are received in screw bosses 16 in the other section 12. Most of the near side section 14 has been broken away in FIG. 1. The case 10 includes a barrel portion 18 and a handgrip portion 20 having a trigger guard part 22. A two part pump-operating handle 24 is received to slide lengthwise along the barrel portion of the case and is linked to a piston rod 26 of an air pump 28 by a shaft 30 that extends transversely through the case, extends laterally outwardly from within the case through guide slots 32 in the case sections (only one slot is shown) and has its respective ends held in sockets (not shown) in the respective halves of the handle on opposite sides of the barrel portion of the case.

When the user slides the handle back and forth along the barrel portion, the piston rod 26 moves a piston 34 (FIG. 3) through a cylinder member 36 of the pump, thereby pumping air into a tank 38. The tank has an externally threaded neck portion 38*a* and is joined to the case by screwing the neck into an internally threaded socket portion 40 of the case 10. The bottle is removed from the case for filling, when the toy is to be used with water, and is also removed in some cases to change the mode of operation, as described below. Air or air and water in the tank that are pressurized by operation of the pump are kept from being expelled by a normally closed discharge control valve 42 (FIG. 3), which forms part of a pump/valve subassembly of the water gun. When a trigger 44 is pulled by the user, the discharge control valve is opened, and air, a mixture of water and air, or water under pressure, as the case may be depending on the mode of operation selected by the user, is conducted through a discharge tube 46 to and out of a nozzle 48.

Figure 3:
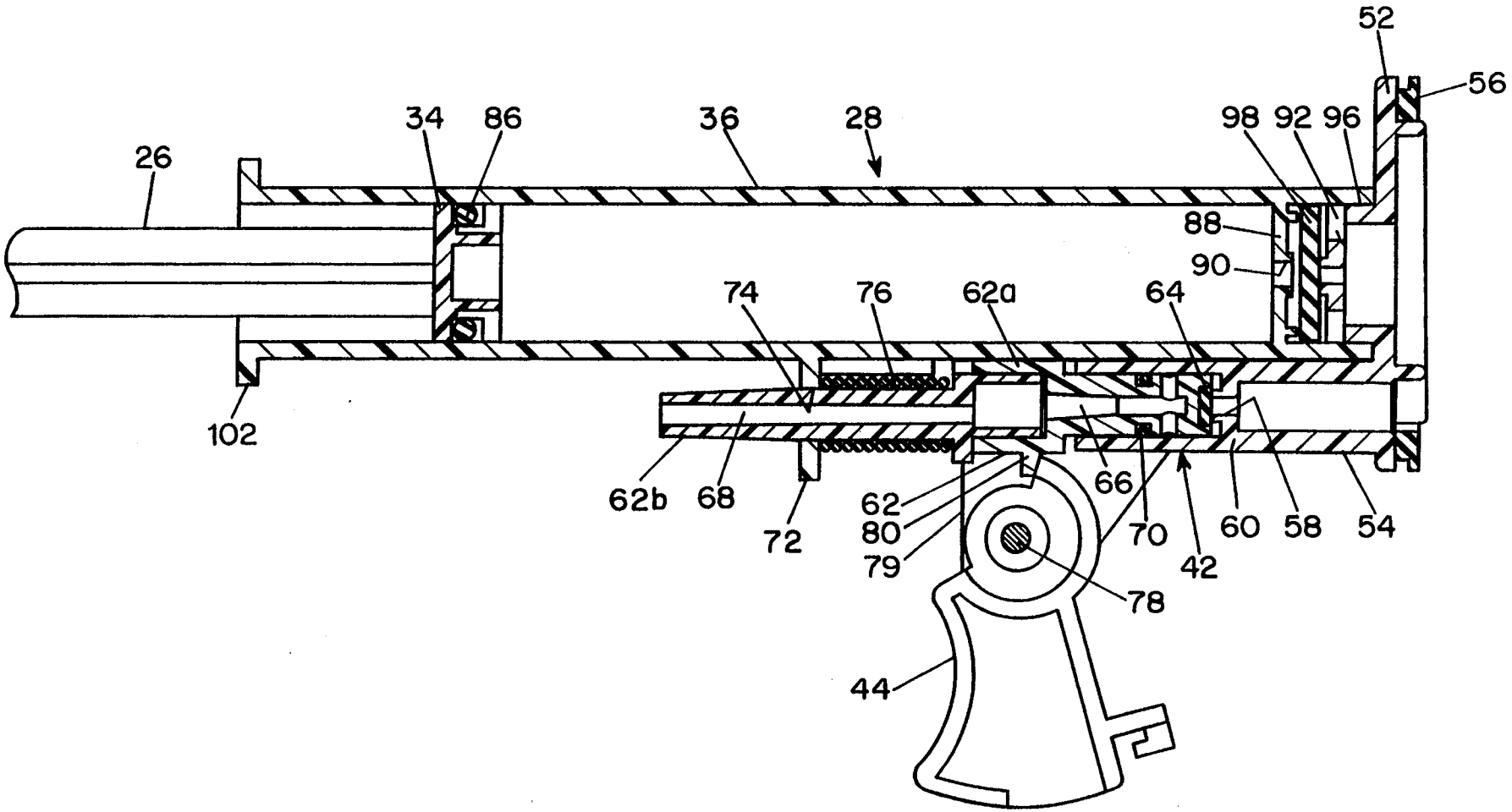
FIG. 3 is a side cross-sectional view of the pump-/valve subassembly of the embodiment.

Referring now to FIG. 3, the pump/valve sub-assembly comprises the pump 28 and the discharge control valve 42. A flange plate 52 affixed to the outlet end of the cylinder member 36 has an integral tubular boss portion 54 extending from it externally of the cylinder member outlet. The boss portion serves as the valve body of the discharge control valve 42. An annular gasket 56 on the perimeter of the flange plate laterally outwardly of the cylinder member and the boss portion forms a seal with the neck of the water tank (see FIG. 1), and thus the air pump outlet to the tank and the inlet to the discharge valve communicate directly with the tank.

The valve body (tubular boss portion 54) of the discharge valve has a valve port opening 58 defined by a valve seat 60 in the form of a transverse wall portion of the valve body. The discharge valve further includes a valve flow tube 62 slidably supported at one end portion in the valve body by reception telescopically within a portion thereof and carrying a flow tube gasket 64 at its end adapted to form a seal with the valve seat 60. To facilitate molding, the valve flow tube is made in two parts 62*a* and 62*b*. Part 62*a* is in clearance with the inner wall of the valve body 54 so that when it is moved away from the flange plate to unseat the gasket 64 from the seat 60, water under pressure from the tank 38 can flow in the annulus and through passages 66 and 68 and thence through the discharge tube 46, which is attached to the flow tube part 62*b* (see FIG. 1) An O-ring 70 seals off the annulus upstream from the passage openings in the tube part 62*a*.

A laterally extending valve tube support arm 72 having a guide hole 74 is attached (such as by molding it integrally) to the cylinder member 36. The valve flow tube part 62*b* is slidably supported in the guide hole of the support arm, and a compression spring 76 is engaged between the support arm and the valve flow tube and biases the valve flow tube in a direction to seat the flow tube gasket 64 on the valve seat 60. The trigger 44, which is pivotally mounted on a pin 78 received in a pair of arms 79 projecting from the cylinder member 36, engages a projecting lug 80 on the valve flow tube. When the user pulls the trigger, the valve flow tube 62 is displaced against the bias of the compression spring, thereby opening the discharge control valve. The discharge tube 46 is flexible and is trained through the barrel portion 12 of the case such that it has loops that readily deform when the valve flow tube is displaced to open the discharge control valve.

A flexible tube 82 having a strainer 83 and a metal fitting 84 on its end to weight the end down (see FIG. 1) to the lowermost part of the tank is connected to a generally Y-shaped fitting 85 that, in turn, fits telescopically into the intake side of the passage in the valve body and conducts air or water under pressure from the tank when the gun is being "fired." It will be noted that the tube 82 and fitting are not subject to any pressure difference, so they need only be soundly attached to the discharge control valve mechanically but do not have to form seals against a pressure difference.

The pump piston has a conventional O-ring type one-way seal 86. When the user pulls the piston toward the tank, movement of the O-ring is frictionally retarded by engagement with the cylinder wall and the O-ring seats on the land of the ring groove nearer the piston rod, and the air trapped in the cylinder member is pumped into the tank. When the piston is pushed away from the tank the O-ring shifts away from the rod, thereby opening the clearance space between the piston and the cylinder wall and permitting air to be inducted into the cylinder chamber from the rod end through lengthwise slots in the piston.

The cylinder member 28 has a transverse wall 88 closely adjacent the outlet end. The transverse wall has a hole 90 in it to permit air to flow through it to the outlet end of the cylinder member. A seal retainer disc 92 is received in the cylinder member between the transverse wall 88 and is held in place in the cylinder member by an annular flange portion 96 on the flange plate 56. The retainer disc has openings to permit air to flow through it to the outlet end of the cylinder member. A flange valve diaphragm 98 is received between the transverse wall and the retainer disc and blocks the flow of air from the tank into the cylinder member through the hole in the transverse wall when the pump piston moves away from the outlet end of the cylinder member, thereby trapping the air pumped into the tank, and permits the flow of air under pressure from within the cylinder member through the hole in the transverse wall when the piston moves toward the outlet end of the cylinder member. The diaphragm is a flexible (soft) rubber disc and is loosely received in the space between the wall and retainer disc with clearance from the cylinder wall, through which the pumped air passes.

Figure 2:
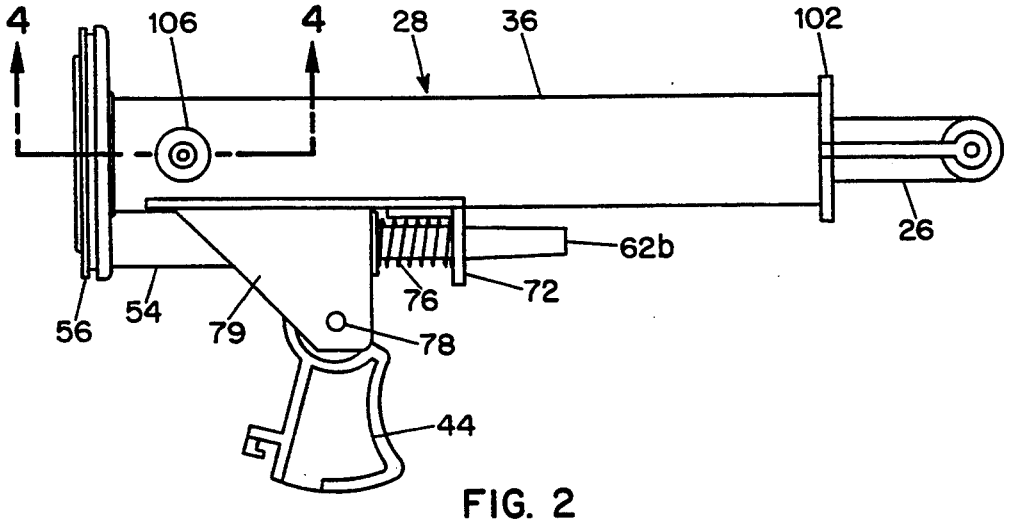
FIG. 2 is a side elevational view of the pump/valve subassembly of the embodiment.
Figure 4:
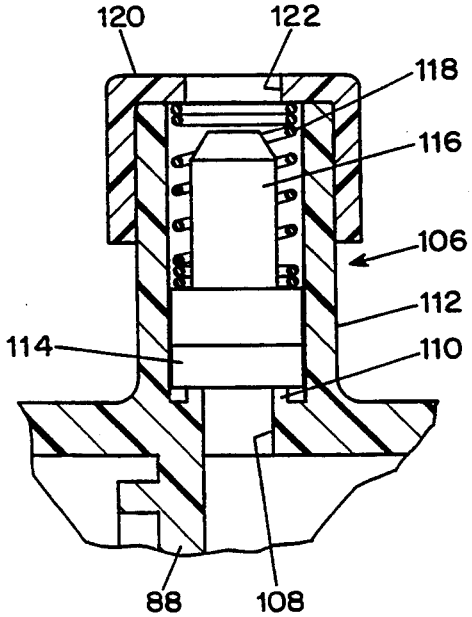
FIG. 4 is a detail cross-sectional view of the pressure-relief valve taken along the lines 4—4 of FIG. 2 and shown on an enlarged scale.

An optional but highly desirable feature of the water gun is a pressure-relief valve 106 that communicates with the air pump cylinder member 36 proximate to the outlet end into the tank (see FIG. 2) for preventing the pump from pressurizing the air pumped into the tank to a pressure above a predetermined value. The pressure relief valve 106, shown in detail in FIG. 4, includes a port 108 in the cylinder member surrounded by a valve seat 110, an annular flange 112 surrounding the valve seat, a seal member in the form of a gasket 114 and a plunger 116, and a spring 118 biassing the seal member into sealing engagement with the valve seat and adapted to yield and enable the seal member to unseat from the valve seat when the pressure in the tank reaches the predetermined value. The spring is engaged between the plunger and a cap 120 that fits over the flange 112, is secured to the flange by an adhesive, and has a hole 122 for releasing water and air that is released by the valve. The cap 120 protrudes slightly through a hole (not shown) in the gun case 10. Any water that leaks into the pump cylinder from the tank is released by the valve 106 as a harmless spray, inasmuch as the hole 116 in the cap is large and the water is deflected by the seal as it exits the port.

The skilled observer will see that most of the components of the pump/valve assembly can be injection-molded from suitable polymeric materials in simple two-part molds and that assembly is quick and easy. The diaphragm 98 and retainer 92 are inserted into the cylinder, and the valve flow tube part **62*b*, with the spring 76 in place, is inserted into the guide hole 74 of the arm 72. The O-ring 70 and gasket 60 are fitted to the valve flow tube part 62*a*, which is inserted into the valve body 54 of the flange plate. The flange plate 52 is then installed on the cylinder member 36 using an adhesive or chemical bonding agent between the flange portion 96 and the cylinder member to provide a strong mechanical connection and a seal. The tube 82 and the discharge tube 46 and nozzle can be attached to the pump/valve at this stage or at final assembly. In either case there is enough slack in the discharge tube to enable the nozzle and pusher assembly (described below) to be fitted to it before the case is assembled and then installed on the case with the telescoping relation shown in FIG. 1B**.

It will be seen (FIG. 1) that the pump/valve subassembly is held in position in the case by reception of the perimeter of the flange plate 52 in a groove 100 molded into the case halves and by reception of a flange 102 at the rod end of the cylinder member in a groove 104 in the case. The remaining aspects of the assembly of the gun need not be explained.

A light tension spring 106 biases the trigger against the lug 80 just so that it does not swing freely.

As mentioned above, the edge of the neck **38*a* of the tank is sealed air and water tight to the flange plate of the pump/valve by the gasket 56** when the tank is threaded onto the case. The direct coupling of the pump/valve to the tank is highly advantageous functionally and offers economies in manufacturing time and cost.

One aspect of enabling the four modes of operation of the gun is the provision of a water supply conduit leading from the tank to the discharge valve inlet, an air supply conduit leading from the tank to the discharge valve inlet, and a means for selectively opening and closing the air supply conduit so as to permit or prevent, respectively, air from flowing from the tank to the discharge valve. In the embodiment, the water supply conduit consists of the flexible tube 82 and a passage 851 in the fitting 85. The air supply conduit is a branch passage 852 in the fitting 85 that leads from the upper end of the branch arm 853 to a juncture with the passage 851, a common portion of which serves as part of both the air and water supply conduits. A web portion 854 of the fitting 85 has a nose portion 855 and laterally extending arms 856 that fit into the end of the pump cylinder bore, thus more securely joining the fitting 85 to the pump/valve subassembly.

A two-position cap 130 fits firmly onto the upper end of the branch arm 853. One cap portion 1301 has a hole 1302 that permits air to pass through to the passage 852. The other portion 1303 has no hole and blocks off the passage 852 from the tank when it is installed on the branch arm. The portion 1301 with the hole is not required from the point of view of the functioning of the toy but serves to keep the cap from dangling from its tethering cord 132 and ensure that the cord does not inadvertently get caught in the threaded connection between the tank and case during reattachment of the tank to the case.

Figure 5A:
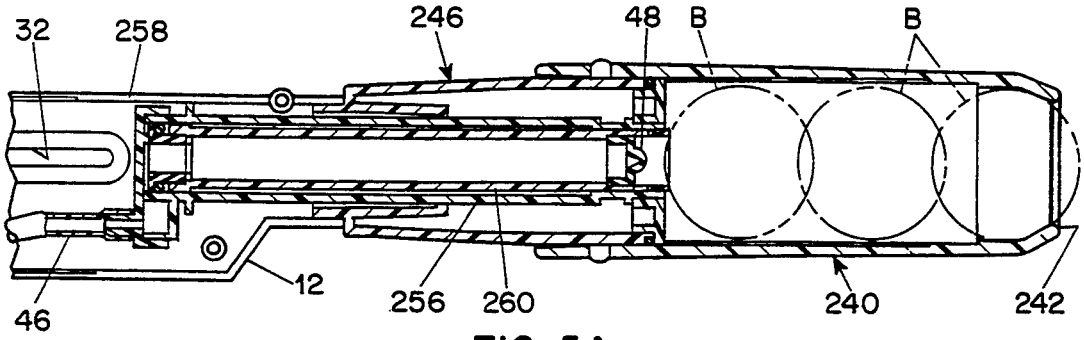
FIGS. 5A, 5B, 5C and 5D are fragmentary side cross-sectional views of the ball pusher mechanism and the ball magazine and show how they operate.

Another aspect of providing for multiple selected modes of operation of the toy is a ball magazine defining an air pressure chamber adapted to receive a compressible ball and having an opening that is smaller than the ball so that the ball is discharged through the opening only when a predetermined force due to air pressure in the chamber is applied to it, whereupon the ball is deformed and is discharged from the magazine. In the embodiment, the magazine 240 (FIG. 1B) is a tubular member that has an opening 242 at one end and is received at its open opposite end 244 telescopically over the end of a coupling and push rod sub-assembly 246 that is attached to and forms an extension of the barrel. An O-ring seal 248 and a collar 250 on the end of the coupling assembly of the barrel close the end 244 of the magazine. A spherical, moderately compressible ball B to be shot from the toy closes the end opening 242 see, e.g., FIG. 5A). Air under pressure from the tank is supplied to the closed magazine chamber when the trigger is pulled and applies a force on the ball sufficient to deform it so that it can pass out through the opening an be propelled toward a desired target. The force on the ball required to expel it from the chamber, and the resulting energy imparted to it, are a function of the compressibility of the ball and the size of the opening, which can be varied to obtain the desired shooting characteristics. The pressure in the tank does not affect the shooting force and the velocity and range of the ball, but of course the available pressure supplied by the tank cannot be less than that required to force the ball through the opening 242.

The magazine 240 in the illustrated toy can receive up to three balls, and a longer magazine could receive even more balls. In order to move successive balls into the opening 242 for shooting, there is a pusher assembly 246 that fits into and is attached to the end portion of the barrel of the case 10. A tubular coupling body 252 having a reduced diameter end flange portion 254 that is received in the barrel end opening couples the magazine 240 to the case. Within the body 252 is a cylinder 256, the distal end 2561 of which fits into and is secured to a hole in the collar 250, which in turn is secured to the coupling body 252. The proximal end 2562 receives and is secured to an end fitting 258 having an inlet tube 2581 to which the end of the discharge tube 46 from the discharge valve is connected. A hollow piston 260 having the nozzle 48 at one end and an O-ring seal 262 at the other end is slidably received in the cylinder 256.

Depending on the mode of operation selected by the user, as described below, air or a mixture of air and water, i.e., a fluid, is conducted from the tank 38 when the trigger 44 is pulled to open the discharge valve 42, passes though the tube 46, enters the cylinder 256 through the fitting 258, and because the piston is hollow fills the piston. Because the nozzle 48 is a restriction, a pressure difference will form across the piston and push it from left to right (see FIG. 7B, 7C, and 7D). That motion will move a ball or balls along the magazine 240 and seat a ball in the magazine opening 242. The nozzle orifice is set in from the end of the piston 256, and notches in the piston end allow the fluid to flow into the magazine chamber past the ball that the piston end engages. The balls B fit loosely in the magazine when they are relaxed, but the length of the chamber is such that when three of the balls are loaded into the chamber, they are compressed in the axial direction in order to engage the endmost ball firmly in the opening 242. Lest fluid flow past the two balls remote from the opening be blocked, grooves 2401 are formed into the inner surface of the magazine.

The balls B are loaded into the magazine 240 by removing the magazine from the coupling assembly 246, inserting the balls into the magazine, and replacing the magazine. The magazine is attached to the coupling assembly by a pair of diametrically opposite bayonet couplings 270, each of which consists of an L-shaped slot in the magazine (not visible) and a pin 272 on the coupling body 252.

When the toy is to be used to shoot balls alone, it does not matter whether the cap 130 is positioned to block flow or permit flow from the tank through the air supply conduit 852, inasmuch as air can flow from the tank through the water supply conduit 851. The balls-alone mode of use requires that there be no water in the tank. The user pumps air into the tank by pulling the handle 24 back and forth, thereby moving the piston back and forth in the pump cylinder and forcing air into the tank. If the user tries to pump an excessive amount of air into the tank, the pressure-relief valve 106 will open on each pumping stroke and release air through the valve. After the tank is pressurized, the user pulls the trigger, thereby opening the discharge valve 42. Air flows through the discharge tube 46 and into the cylinder 256. If there are three balls in the magazine (FIG. 5A), the pusher/piston 260 will not displace, and air will pass into the magazine, flow along the grooves 2401 and build up pressure in the magazine chamber. As the pressure builds up in the magazine chamber, the ball in the end opening 242 of the magazine gradually deforms and moves through the opening 242 as the force due to the air pressure is applied to it by the incoming flow of pressurized air from the tank. Finally, the ball passes far enough through the opening so that no deformation is required to allow it to pass through the opening, and the pressure force expels the ball with a high acceleration, imparting a high velocity to it.

Figure 5B:
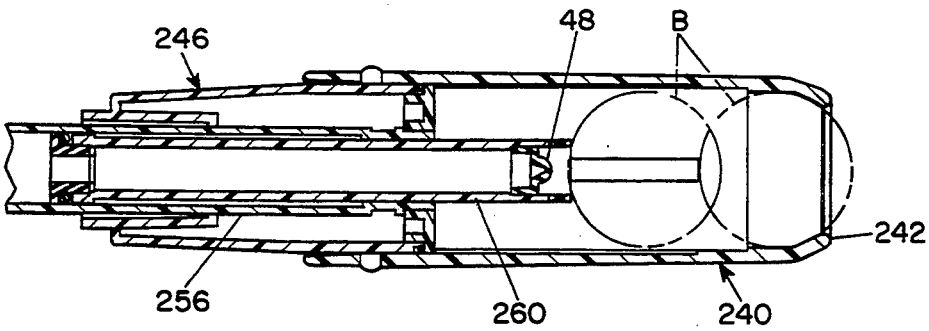
Figure 5C:
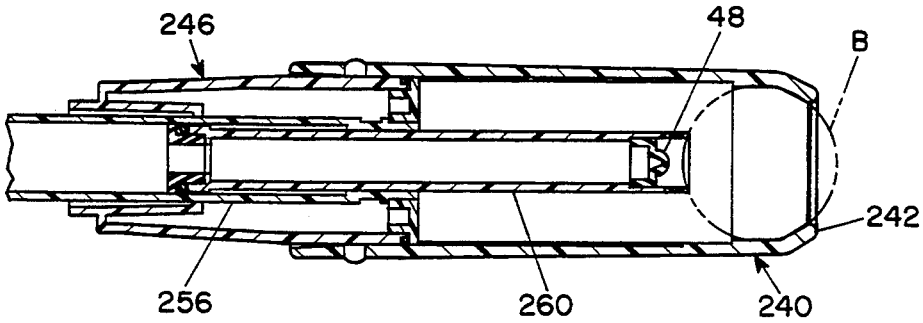

The operation of the toy to eject a ball when only one or two balls are present in the magazine is essentially the same as the operation with three balls. In these cases, however, the initial flow of air into the cylinder 256 of the pusher assembly 246 from the discharge tube results in a pressure difference across the hollow piston 260, due to the restriction of the nozzle 48. Accordingly, the piston 260 is displaced and pushes the ball or balls in the magazine into the opening 242. Thereafter, the air pressure builds up in the magazine chamber and ejects the ball in the opening. The operation of the toy with less than three balls is readily apparent from FIG. 5B and 5C.

Figure 5D:
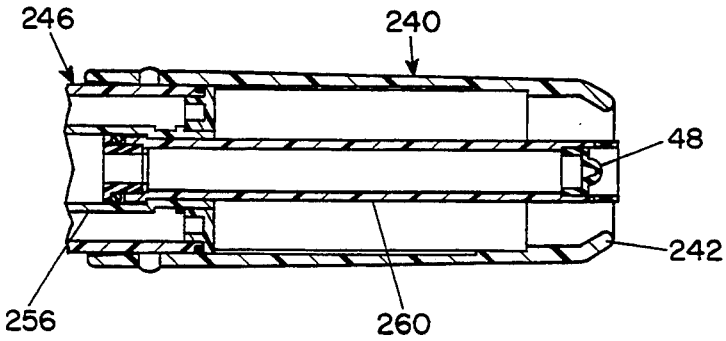

When the toy is used to shoot a water spray (water and air) or a water jet (water only), the pressure difference across the nozzle 48 causes the piston 260 to extend all the way to the end opening 242, as shown in FIG. 5D.

To shoot balls and a water spray, the cap 130 is installed on the lateral arm 853 of the fitting 85 with the portion 1301 having the hole 1302 fitted to the arm, so that air can flow to the discharge valve and discharge tube through the conduit 852. The tank is filled only part way with water to a level below the hole 1302. After air is pumped into the upper part of the tank, pulling the trigger will allow both air and water to flow through the discharge valve and the discharge tube. After the ball is ejected in the manner described above by air pressure in the tube, it is followed by a spray of water from a quantity of water that enters the magazine chamber. If only one ball is in the magazine, the water will continue to shoot as a spray from the nozzle (FIG. 5D) for as long as the user holds the trigger and the pressure in the tank is sufficient to eject water.

If no balls are loaded into the magazine, the toy shoots a water spray when the cap 130 is in the same position as it is for shooting balls and a water spray and the tank is filled to a level below the hole in the cap.

For shooting water only as a jet, no balls are loaded into the magazine, the cap 130 is installed with the part 1303 without a hole in place on the arm 853, thereby closing the air conduit 852, and the tank is filled with water, but leaving some room for air. In this water-only mode, the toy operates in essentially the same way as the "KAHUNA" water gun of the patent referred to above, except the pusher piston 260 is extended to the position shown in FIG. 5D.

The pusher assembly 246 is not required for toys according to the invention that have a magazine that holds only a single ball. In such a toy, the nozzle can be fixed to the case and the magazine detachably connected to the nozzle body. The length of the magazine should be shorter than the ball diameter to ensure that the ball fits snugly into the outlet opening of the magazine and forms a seal against air pressure built up in the magazine chamber.

I claim:

1. A toy that selectively shoots a compressible ball or a water stream comprising a tank adapted to contain air and water under pressure in proportions selected by a user, pump means for pumping air into the tank, a discharge valve having an inlet and an outlet, a fluid supply conduit leading from the tank to the discharge valve inlet and adapted to conduct air and/or water from the tank, depending on the contents of the tank, a ball magazine defining an air pressure chamber adapted to receive selectively at the option of the user a multiplicity of compressible balls and having an opening that is smaller than the balls so that each ball is discharged through the opening only when a predetermined force due to air pressure in the chamber is applied to it, whereupon the ball is deformed and is discharged from the magazine, a discharge conduit leading from the discharge valve outlet to the ball magazine chamber and having a nozzle opening into the chamber, the fluid discharge conduit being adapted to conduct air and/or water from the discharge valve to the outlet, depending on the contents of the tank, and means including a pusher member movable by fluid pressure delivered from the tank when the discharge valve is opened for pushing a ball or balls in the magazine chamber toward the magazine opening so that a ball next to be shot seats in the opening and pressure can build up in the magazine chamber.

2. A toy according to claim 1 wherein the pusher member is a piston received in a cylinder and the cylinder receives fluid from the tank through the discharge conduit.

3. A toy according to claim 2 wherein the pusher member has a passage having one end communicating with the discharge conduit and the nozzle is attached to the end of the pusher member proximate to the magazine and communicates with the passage.

4. A toy according to claim 3 wherein the magazine is configured to enable fluid to bypass balls received in it remote from the ball seated in the opening so that pressure is applied directly to the ball seated in the opening.

5. A toy according to claim 4 wherein the magazine has lengthwise extending grooves that enable fluid to bypass balls received in it.

6. A toy according to claim 4 wherein the end of the piston proximate to the magazine is annular, projects beyond the nozzle, and has openings to enable fluid to flow into the chamber past a ball engaged by the annular end of the pusher.

7. A toy according to claim 1 wherein the magazine is configured to enable fluid to bypass balls received in it remote from the ball seated in the opening so that pressure is applied directly to the ball seated in the opening.

8. A toy according to claim 7 wherein the magazine has lengthwise extending grooves that enable fluid to bypass balls received in it.

9. A toy according to claim 1 and further comprising an air supply conduit leading from the tank to the discharge valve inlet, and means for selectively opening and closing the air supply conduit to enable or prevent, respectively, air from flowing from the tank to the discharge valve inlet through the air supply conduit, whereby the toy is adapted to shoot simultaneously a ball and a water spray when the air supply conduit is open, the tank contains both water and air, and a ball is in the magazine and shoot a water spray alone when the tank contains both water and air and no ball is present in the magazine.

10. A toy according to claim 9 wherein the air supply conduit is a substantially rigid tube and has an opening for receiving air in the tank located a substantial distance above the bottom of the tank when the toy is in use so that the opening is above the level of a quantity of water received in the bottom of the tank.

11. A toy according to claim 9 wherein the means for selectively opening and closing the air supply conduit is a detachable cap that covers and closes the opening of the conduit when it is attached to the conduit.

12. A toy according to claim 1, the toy resembling a gun, and further comprising a case having a barrel and a handle, the nozzle being located at the end of the barrel.

13. A toy according to claim 12 wherein the tank is removably attached to the case.

14. A toy according to claim 12 wherein the magazine is removably attached to the end of the barrel.

15. A toy according to claim 12 wherein the magazine and the end of the barrel are tubular, the magazine is telescopically received over the end portion of the barrel, and a seal is provided between the end portion of the barrel and the magazine.

16. A toy according to claim 15 wherein the magazine is removably attached to the barrel by a bayonet coupling.

17. A toy according to claim 12 wherein the pump means is received in the case and includes a cylinder member forming a chamber, a piston/piston rod received in the cylinder member, a one-way valve on the piston, and a one-way valve in an outlet end of the cylinder member, wherein the tank has a neck and is attached to the case at the neck, and wherein a portion of the outlet end of the pump cylinder engages a portion of the neck of the tank in sealed relation.

18. A toy according to claim 17 wherein the tank is detachable from the case.

19. A toy according to claim 18 wherein the cylinder member has a flange plate at its outlet end that engages the neck of the tank, an integral tubular boss extends from the flange plate externally of the cylinder member outlet, the boss being a valve body of the discharge valve, and an annular gasket on the perimeter of the flange plate laterally outwardly of the cylinder member forms a seal with the neck of the tank, whereby both the air pump outlet to the tank and the inlet to the discharge valve communicate directly with the reservoir.

20. A toy according to claim 19 wherein the valve body of the discharge valve has a valve port opening defined by a valve seat, and the discharge valve includes a valve flow tube slidably supported in the valve body by reception telescopically within a portion thereof and carrying a flow tube gasket adapted to form a seal with the valve seat.

21. A toy according to claim 20 wherein a valve tube support arm having a guide hole is attached to the cylinder member, the valve flow tube is slidably supported in the guide hole of the support arm, and a compression spring is engaged between the support arm and the valve flow tube and biases the valve flow tube in a direction to seat the flow tube gasket on the valve seat.

22. A toy according to claim 21 and further comprising a trigger engaging the valve flow tube and moveable to move the valve flow tube against the bias of the compression spring and thereby open the discharge valve.

23. A toy according to claim 22 wherein the cylinder member has a transverse wall closely adjacent the outlet end, the transverse wall has a hole in it to permit air to flow through it to the outlet end of the cylinder member, wherein a seal retainer disc is received in the cylinder member between the transverse wall and the flange plate, the retainer disc has openings to permit air to flow through it to the outlet end of the cylinder member, the flange plate has an annular flange received within the outlet end of the cylinder member and engaging the retainer disc, and a flange valve diaphragm is received between the transverse wall and the retainer disc and blocks the flow of air from the reservoir into the cylinder member through the hole in the transverse wall when the pump piston moves away from the outlet end of the cylinder member and permits the flow of air from within the cylinder member through the hole in the transverse wall when the piston moves toward the outlet end of the cylinder member.

24. A toy according to claim 17 and further comprising pressure-relief valve means communicating with the cylinder member proximate to the outlet end for preventing the pump from pressurizing the air pumped into the tank to a pressure above a predetermined value.

25. A toy according to claim 24 wherein the pressure relief valve means includes a port in the cylinder member surrounded by a valve seat, an annular flange surrounding the valve seat, a seal member, and a spring biassing the seal member into sealing engagement with the valve seat and adapted to yield and enable the seal member to unseat from the valve seat when the pressure in the reservoir reaches the predetermined value.

* * * * *